US008784241B2

(12) United States Patent
Ryan et al.

(10) Patent No.: US 8,784,241 B2
(45) Date of Patent: Jul. 22, 2014

(54) RACQUET IDENTIFICATION SYSTEM

(71) Applicants: Christopher W. Ryan, Bartlett, IL (US); John B. Lyons, Wilmette, IL (US); Ryan Dowd, Fishers, IN (US); Kyle Dowd, Fishers, IN (US)

(72) Inventors: Christopher W. Ryan, Bartlett, IL (US); John B. Lyons, Wilmette, IL (US); Ryan Dowd, Fishers, IN (US); Kyle Dowd, Fishers, IN (US)

(73) Assignee: Wilson Sporting Goods Co., Chicago, IL (US)

( * ) Notice: Subject to any disclaimer, the term of this patent is extended or adjusted under 35 U.S.C. 154(b) by 154 days.

(21) Appl. No.: 13/663,859

(22) Filed: Oct. 30, 2012

(65) Prior Publication Data

US 2013/0252769 A1 Sep. 26, 2013

Related U.S. Application Data

(60) Provisional application No. 61/613,713, filed on Mar. 21, 2012.

(51) Int. Cl.
*A63B 49/00* (2006.01)

(52) U.S. Cl.
USPC ..... 473/537; 473/553

(58) Field of Classification Search
USPC ..... 473/524, 537, 538, 553
See application file for complete search history.

(56) References Cited

U.S. PATENT DOCUMENTS

| | | | | |
|---|---|---|---|---|
| 3,515,386 | A * | 6/1970 | Mason | 473/463 |
| 5,356,137 | A | 10/1994 | Carvalho | 273/73 |
| 6,089,997 | A * | 7/2000 | Hauptman et al. | 473/524 |
| 6,530,486 | B1 | 3/2003 | Batting et al. | 211/57.1 |
| 7,335,120 | B1 * | 2/2008 | Pittner | 473/553 |

FOREIGN PATENT DOCUMENTS

| | | |
|---|---|---|
| DE | 24 01 919 | 5/1975 |
| DE | 37 05 033 | 8/1988 |
| FR | 2 433 955 | 3/1980 |

* cited by examiner

*Primary Examiner* — Nini Legesse
(74) *Attorney, Agent, or Firm* — Terence P. O'Brien

(57) ABSTRACT

A racquet identification system for use with at least first and second racquets supported by a multi-racquet support structure. Each of the first and second racquets includes a head portion. The system includes first and second head cards coupled to the head portion of the first and second racquets, respectively. The first and second head cards include first and second bodies and first and second projections extending from the first and second bodies, respectively. The shape of the first body is similar to the shape of the second body. The first body and the first projection define a first orientation. The second body and the second projection define a second orientation. The first and second orientations are different. The first and second racquets have at least one characteristic that varies between the first and second racquets, and the first and second projections are configured to highlight the characteristic.

21 Claims, 9 Drawing Sheets

RACQUET IDENTIFICATION SYSTEM

RELATED APPLICATIONS

The present application claims priority to U.S. Provisional Patent Application Ser. No. 61/613,713 titled RACQUET IDENTIFICATION SYSTEM, and filed on Mar. 21, 2012.

FIELD OF THE INVENTION

The present invention relates generally to a plurality of sports racquets supported by a multi-racquet support structure. In particular, the present invention relates to a system for facilitating the identification of racquets on display, and for distinguishing one racquet from another.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Racquets are made in many different sizes, lengths, weights, shapes, colors and other characteristics. Racquets are also frequently made to meet the needs of certain types of users based upon an age range, a height range, a user skill level or other user characteristics. Racquets can be initially produced as un-strung, in which the racquet is sold without racquet string, or pre-strung, wherein the racquet is produced and sold with a string bed of racquet string on the head portion of the racquet. New racquets, whether un-strung or pre-strung, typically include a head card positioned either attached to the string bed or positioned within the head portion generally along a plane that defines the string bed. The head card is used to identify the brand of the racquet, the racquet model, and other characteristics and related information about the racquet.

Sports racquets are often sold at retail stores where dozens of racquets are displayed on a wall or on an aisle. The walls or aisles typically include outwardly projecting multi-racquet supports structures, often referred to as pegs. Racquets can be relatively large items which, when displayed, can take up a fair amount of available wall or aisle space of a retail store. Therefore, in order to conserve valuable display space, it is common for a retailer to position a plurality of racquets including 2, 3, 4, 5, 6 or more racquets onto a single peg. The racquets are typically hung or suspended by the top of the head portion with the handle portion positioned beneath the head portion and the head card facing outward. The racquets are typically positioned in groups such that the head portion and head card of the second outermost racquet is directly behind the outermost racquet, third outermost racquet is directly behind the second outermost racquet, and so on.

In many larger sporting goods stores, department stores or "big-box" stores, sports racquets can be displayed by sport (e.g. tennis, racquetball, etc.), brand, price point or price range, racquet characteristics, or user characteristics. Often different or multiple racquet models are displayed on the same peg in such stores. When this occurs, the consumer typically only notices the forward-most or outermost racquet on the peg. In other words, the racquet that is uncovered by the other racquets on the same peg. It is common for consumers to assume that all the racquets on the same peg are the same. As a result, many consumers will not remove the outermost racquet, or otherwise move aside a portion of the outermost racquet, to get a better view of the racquets behind the outermost racquet. Thus, racquets that are not positioned as the outermost racquet on a peg are less likely to be noticed, examined and/or purchased by the consumer than the outermost racquet on a peg. Additionally, many consumers don't want to remove racquet after racquet from a single peg in the hopes of finding a racquet that meets their particular needs. Such an approach can be difficult for the consumer to accomplish and can lead to the consumer becoming frustrated and not returning the racquets to their original position after being removed from a peg and not selected for purchase.

Accordingly, a need exists for a way to overcome or reduce the likelihood of a consumer viewing an outermost racquet and failing to realize or recognize that a racquet having a different characteristic than the outermost racquet is positioned behind the outermost racquet or outermost racquets. What is needed is a system that will allow a consumer to readily identify that multiple types of racquets are present on a single peg. What is needed is a mechanism that will allow for a consumer to quickly distinguish between multiple racquets on a single peg and go to the racquet that interests the consumer. There is a need for a system that will increase the likelihood that racquets positioned away from the outermost position on a peg will be noticed, examined and purchased by a consumer.

SUMMARY OF THE INVENTION

The present invention provides a racquet identification system for use with a multi-racquet support structure. The identification system includes at least first and second racquets and at least first and second head cards. Each of the at least first and second racquets has opposing front and back sides and includes a head portion. The at least first and second racquets are configured to be supported by the multi-racquet support structure such that the back side of one of the at least first and second racquets is adjacent to the front side of another of the at least first and second racquets. The at least first and second racquets have at least one characteristic that varies between at least the first and second racquets. The at least first and second head cards are coupled to the head portion of the at least first and second racquets, respectively. The at least first and second head cards include at least first and second bodies and at least first and second projections extending from the at least first and second bodies, respectively. The shape of the first body is substantially similar to the shape of the second body. The first body and the first projection define a first spacial orientation. The second body and the second projection define a second spacial orientation. The first spacial orientation is different than the second spacial orientation.

According to a principal aspect of a preferred form of the invention, a racquet identification system for use with at least first and second racquets supported by a multi-racquet support structure, wherein each of the at least first and second racquets includes a head portion, includes at least first and second head cards. The at least first and second head cards are coupled to the head portion of the at least first and second racquets, respectively. The at least first and second head cards include at least first and second bodies and at least first and second projections extending from the first and second bodies, respectively. The shape of the first body is substantially similar to the shape of the second body. The first body and the first projection define a first spacial orientation. The second body and the second projection define a second spacial orientation. The first spacial orientation is different than the second spacial orientation. The at least first and second racquets has at least one characteristic that varies between at least the first and second racquets. The at least first and second projections are configured to highlight the at least one characteristic.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
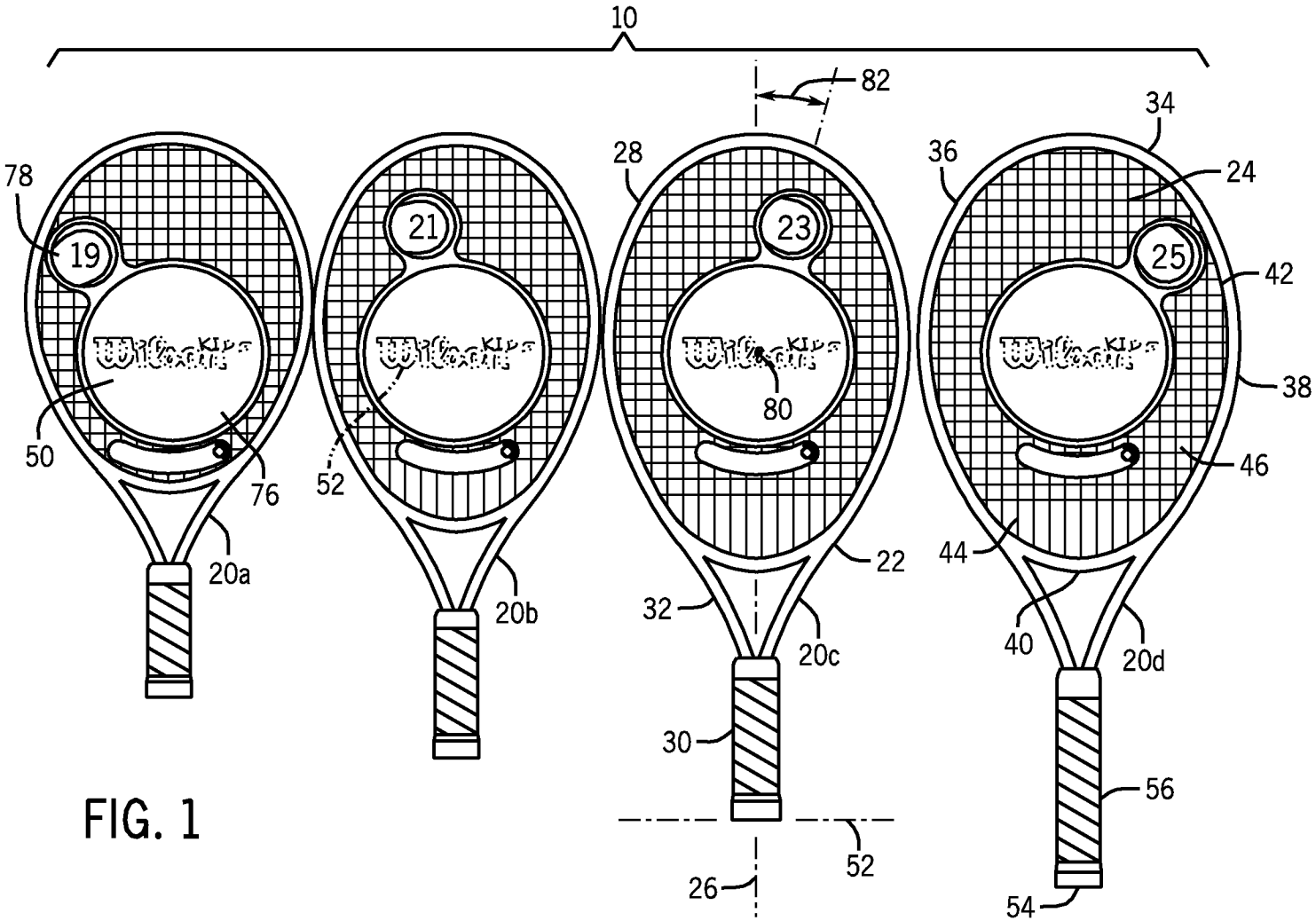
FIG. 1 is a front view of a set of racquets that vary by at least one characteristic and including a racquet identification system in accordance with a preferred embodiment of the present invention.

Referring to FIG. 1, a racquet identification system 10 is shown. The racquet identification system 10 is configured to facilitate the identification of two or more racquets that vary from one another in at least one characteristic, and to facilitate the ability of a person, such as a consumer, to readily distinguish one racquet from another even when the racquets are displayed one in front of another. FIG. 1 illustrates a set of four racquets 20. The racquet identification system 10 of the present invention is configured for use with two, three, four, five, six, or more racquets 20 positioned one in front of another. The racquets 20 of FIG. 1 are configured as a tennis racquet, however, the invention can also be formed as other types of sports racquets, such as, for example, a racquetball racquet, a squash racquet, or a badminton racquet.

The racquet 20 includes a frame 22 and a string bed 24. The frame 22 is a tubular structure having a longitudinal axis 26 and including a head portion 28, a handle portion 30, and a throat portion 32 coupling the head and handle portions 28 and 30. The frame 22 is formed of a lightweight, durable material, preferably a carbon-fiber composite material. As used herein, the term "composite material" refers to a plurality of fibers impregnated (or permeated throughout) with a resin. Alternatively, the frame 22 can be formed of other materials including aluminum, metallic alloys, other composite materials, wood, or combinations thereof.

The head portion 28 of the racquet 20 is preferably a tubular structure that includes a distal region 34, first and second side regions 36 and 38, and a proximal region 40, which collectively define a hoop 42, or string bed area. The hoop 42 can be any closed curved shape including, for example, a generally oval shape, a generally tear-drop shape, a generally pear shape, a generally circular shape and combinations thereof. The hoop 42 or string bed area is configured for receiving and supporting the string bed 24. The string bed 24 is formed by a plurality of main string segments 44 interwoven with a plurality of cross string segments 46. The main and cross string segments 44 and 46 can be formed from one continuous piece of racquet string, or from two or more pieces of racquet string.

A head card 50 is coupled to the string bed 24. The head card 50 is a flexible sheet of a lightweight material, such as cardboard. Alternatively, the head card 50 can be formed of a plastic, paper, a woven or unwoven textile, or combinations thereof. The head card 50 is configured to display graphical and/or alpha-numeric indicia 52 regarding the racquet 20. The indicia 52 can include the racquet brand (e.g. Wilson), other trademarks, the racquet model name, the racquet model no., images of a sponsoring athlete or celebrity, other images, patterns, racquet specifications, price, intended user information, instructional information, material information, and regulatory and/or legal information. The term "characteristics" means a feature or piece of information related to a racquet or the intended users of a racquet. For example, the term "characteristic" can include the length of a racquet, the weight of a racquet, the color or color pattern of a racquet, the racquet model, the head size of the racquet, the shape of the head portion of the racquet, a trademark, the ball type recommended or intended for use with a racquet, the balance point of a racquet, the moment of inertia of the racquet about the longitudinal axis 26, the moment of inertia of the racquet about a lateral axis 52 extending perpendicular to the longitudinal axis 28 at the end of the handle portion 30 of the racquet 20, the recommended or target age range of users of the racquet, the recommended or target height range of the users of the racquet, the skill level of the user of the racquet, and other indicia 52. The head card 50 is preferably attached to the string bed 24 by one or more clips. The head card 50 is intended for display with a new racquet 20 to convey the indicia 52 and characteristics to a potential customer. When the racquet 20 is purchased, the head card 50 is typically removed from the racquet 20 and retained for later reference or discarded.

The handle portion 30 of the frame 22 is an elongate tubular structure that is preferably integrally formed to the frame 22 of the racquet 20. In alternative preferred embodiments, the handle portion 30 is formed separately from the head portion 28 and is coupled together by a vibration and/or shock absorbing material. The handle portion 30 includes a rigid tubular shaft, a pallet, a butt cap 54 and a grip 56. The pallet is a tubular structure that surrounds the shaft and typically defines the general shape of the handle portion 30. The butt cap 54 is a cup-shaped body that extends over and covers a proximal end of the pallet of the handle portion 30. The grip 56 extends over the outer surface of the pallet and preferably at least a portion of the butt cap 54. The grip 56 is an elongate strip of soft, durable material. The grip 56 can be made of a leather, a synthetic leather, a rubber or other thermoset material. The grip 56 is typically spirally or helically wrapped about the outer surface of the pallet, but in alternative embodiments can be a tubular body that is slid over the pallet. The grip 56 is typically secured to the handle portion 30 through use of a suitable adhesive tape. Alternatively, the grip 56 can be attached to the handle portion 30 by other means, such as, for example, a conventional adhesive, thermal bonding or mechanical bonding.

FIG. 1 illustrates one example of a set of racquets 20 that vary by at least one characteristic. In FIG. 1, the four racquets vary in racquet length. Racquet 20*a* can be made with a length of 19 inches when measured about its longitudinal axis, such as axis 26. Racquets 20*b*, 20*c* and 20*d* can be made with racquet lengths of 21 inches, 23 inches and 25 inches, respectively. The set of racquets 20 illustrate racquets formed of four different lengths. In other alternative embodiments, other numbers of racquets and numbers of racquet lengths can be used. In yet other alternative embodiments, the plurality of racquets can be distinguished by another characteristic other than racquet length.

Figure 2:
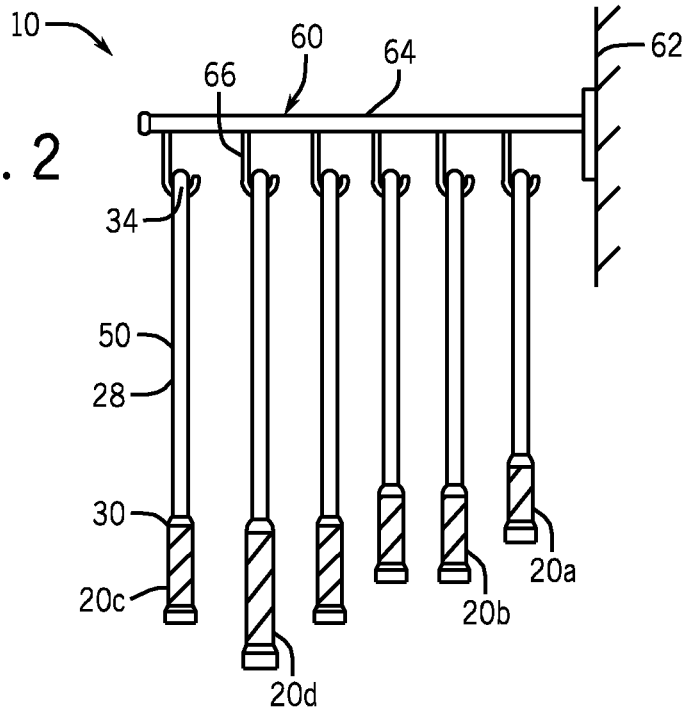
FIG. 2 is a side view of a plurality of racquets supported by a multi-racquet support structure in accordance with the present invention.
Figure 3:
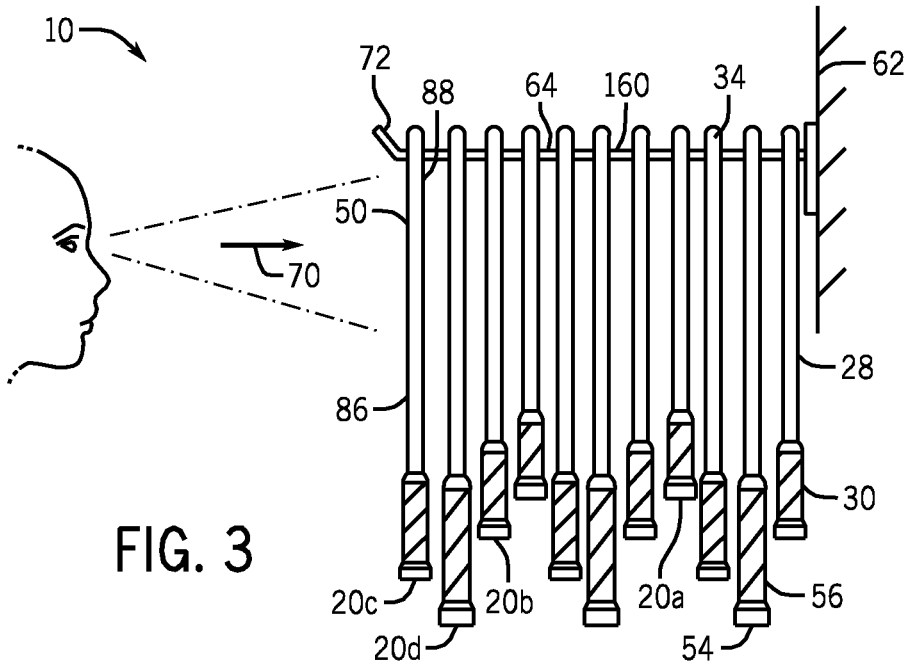
FIG. 3 is a side view of a plurality of racquets supported by another multi-racquet support structure in accordance with the present invention.

Referring to FIGS. 2 and 3, a side view of a plurality of racquets 20 (typically new racquets) displayed in a retail store or retail setting is shown. The racquets 20 are often positioned onto a multi-racquet support structure 60 or 160. The multi-racquet support structure 60 or 160 is a rigid frame that is typically mounted to a support 62, such as a wall 62, an aisle, a fixed frame or other generally vertical surface. The structure 60 includes at least one arm 64 that generally outwardly and horizontally extends from the support 62. In an alternative preferred embodiment, the arm of the multi-racquet support structure may extend from the support 62 at an angle from horizontal, such as, for example, a "waterfall peg". Referring to FIG. 2, the structure 60 can include a plurality of spaced apart hooks 66 extending from the arm 64. Each hook 64 is configured to support at least one of the racquets 20 in a close, but spaced-apart, relationship to other racquets. Typically, the structure 60 engages the racquet 20 at the distal region 34 of the head portion 28 such that longitudinal axis 26 of the racquet 20 is generally perpendicular to the arm 64, with the handle portion 30 positioned below the head portion 28 and the head card 50 facing away from the support 62. The racquets 20 are positioned with an outermost racquet 20*c* in front of a second outermost racquet 20*d*, that in turn can be positioned in front of a third outermost racquet 20, and so on.

Referring to FIG. 3, an alternate design of the multi-racquet support structure 160 is shown extending from the support 62. The structure 160 includes the arm 64 that typically terminates in a hook 72 or knob or raised section. The structure 160 is commonly referred to as a peg. The structure 160 is typically configured to support numerous racquets 20. The racquets 20 are positioned in a manner similar to the racquets of FIG. 2 with the longitudinal axis 26 of the racquets 20 extending generally vertically, the handle portion 30 below the head portion 28, and the head card 50 facing outward away from the surface 62 and toward the consumer. However, unlike FIG. 2, the racquets 20 may contact each other as they are positioned on the structure 160. A consumer or user in the retail store or setting is typically positioned in front of the structure 60 and the plurality of racquets 20 supported from the structure 60. The consumer's line of sight 70 is typically toward the head card 50 coupled to the head portion 28 of the outermost racquet 20.

Figure 4:
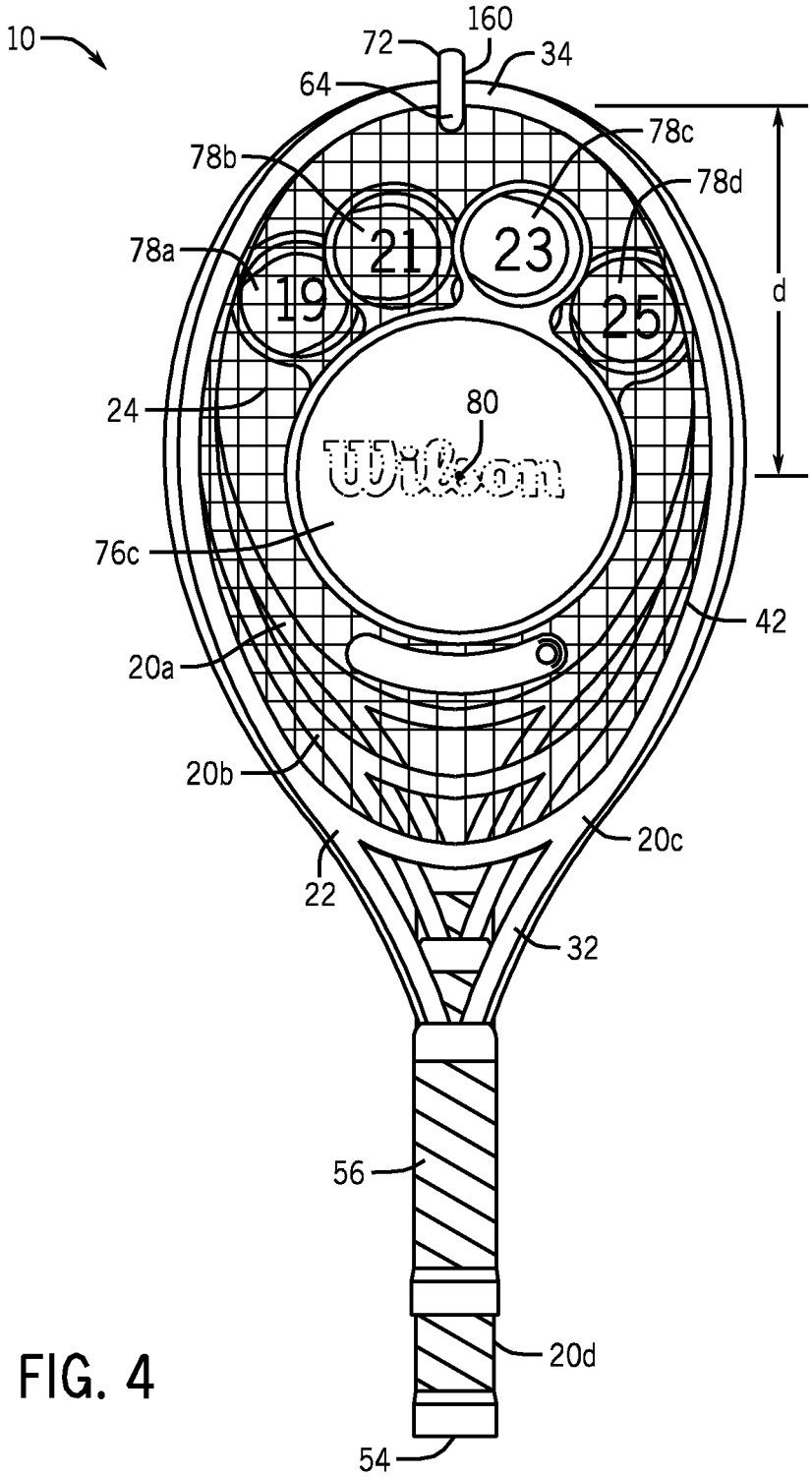
FIG. 4 is a front view of the plurality of racquets supported by the multi-racquet support structure of FIG. 3.

Referring to FIG. 4 the plurality of racquets 20 shown in the side view of FIG. 3 are shown from a front view (or the view typically taken by a consumer, user or other person in a retail setting). FIG. 4 illustrates what is seen by a consumer, user or other person viewing the racquets 20 on the structure 160 from the sight line 70.

Figure 5:
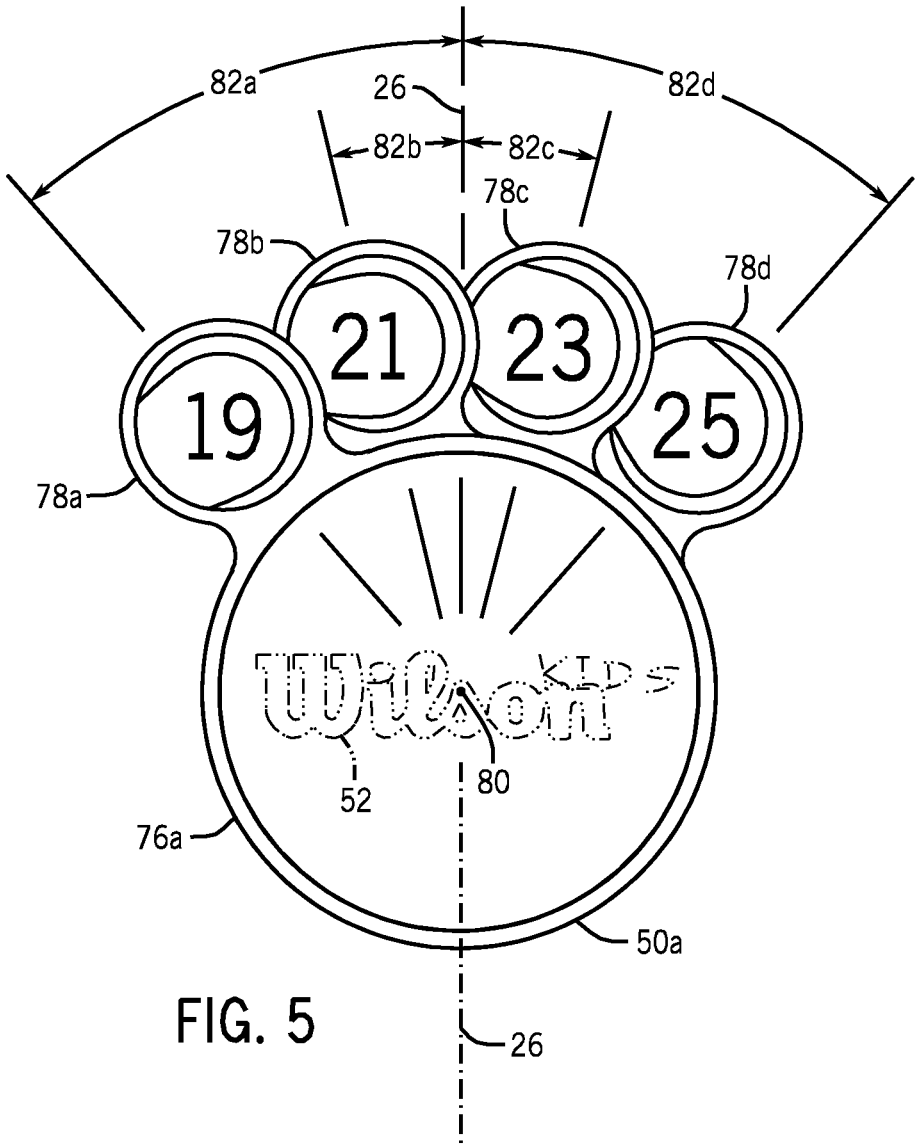
FIG. 5 is a front view of the racquet identification system of FIG. 1.

Referring to FIGS. 1, 4 and 5, each head card 50 includes a body 76 and a projection 78 extending from the body 76. In one particularly preferred embodiment, the body 76 of the head card 50 defines a center point 80 and the projection 78 extends from the body 76 radially so as to define an angle 82 with respect to the longitudinal axis 26 of the racquet 20. Referring to FIG. 5, a first head card 50*a* can include a first projection 78*a* that radially extends from the center point 80 of the head card 50 to define a first angle 82*a* with respect to the longitudinal axis 26. A second head card 50*b* can include a second projection 78*b* that radially extends from the center point 80 of the head card 50*b* to define a second angle 82*b* with respect to the longitudinal axis 26. Similarly, third and fourth head cards 50*c* and 50*d* can include third and fourth projections 82*c* and 82*d* that radially extend from the center points 80 of the head cards 50*c* and 50*d* to define third and fourth angles 82*c* and 82*d* with respect to the longitudinal axis 26, respectively. Each of the head cards 50*a* through 50*d* have a body 76 with a center point 80 that is positioned within the hoop 42 and/or on the string bed 24 such that the center point 80 of each head card 50*a* through 50*d* is at approximately the same distance, d, from the support 160 (and where the support 160 engages the upper region 34 of the head portion 28 of the racquet 20). In this manner, the bodies 76*a* through 76*d* of the head cards 50*a* through 50*d* generally align with each other when viewed from the sight line 70. In other words, the body 76*c* of the head card 50*c* of the outermost racquet 20*c* substantially overlaps the bodies 76*a*, 76*b* and/or 76*d* of the racquets 20*a*, 20*b* and/or 20*d* positioned behind the outermost racquet 20*c* on the support 160, when viewed from sight line 70. In a preferred embodiment, the head card 50 extends over at least 25 percent of the transverse area defined by the hoop 42 or the plane defined by the string bed 24. In another preferred embodiment, the head card 50 extends over at least 50 percent of the transverse area defined by the hoop 42 or the plane defined by the string bed 24. In other embodiments, the head card can extend over other percentages of the area defined by the hoop or the plane defined by the string bed.

Referring to FIG. 4, when viewed facing the outermost racquet 20*c* (the sight line 70), the consumer can readily see the entire head card 50*c* including the body 76*c* and the projection 78*c*. The consumer can also see the other three projections 76*a*, 76*b* and 76*d* through the hoop 42 and string bed 24 of the outermost racquet 20*c*. In this manner, the consumer can readily identify that more than one type of racquet 20 is being supported by the peg or support structure 160, and the consumer can readily distinguish one racquet 20 from the other. The visibility of the projections 76*a*, 76*b* and 76*d* of the head cards 50*a*, 50*b* and 50*d* through the hoop 42 (and the string bed 24) of the outermost racquet 20*c* enables the user to readily see, understand and comprehend that racquets having at least one different characteristic (racquets 20*a*, 20*b* and 20*d*) lie behind the outermost racquet 20*c*. The consumer can also readily determine by viewing the projections 76*a*, 76*b* and 76*d* how far in or how many racquets back the different racquets are on the support 160. The identification system 10 saves the user the hassle of pulling the racquets 20 off one at a time in search of a different racquet (and it reduces the likelihood that the consumer will simply move on or scan to an adjacent peg). In this way, the consumer can readily see that a racquet (20*a*, 20*b* or 20*d*) with a different characteristic from the outermost racquet 20*c*, is positioned X number of racquets back on the support 160, the user can easily rotate that racquet on the support 160 to view its features, characteristics and head card, or remove the exact number of racquets in front of the desired racquet quickly, efficiently and accurately.

The first and second outermost racquets 20*c* and 20*d* have opposing front and back sides 86 and 88. The racquets 20*c* and 20*d* are positioned in FIG. 3 with the back side 88 of the outermost racquet 20*c* adjacent to the front side 86 of the second outermost racquet 20*d*. Referring to FIGS. 4 and 5, the shape of the bodies 76*a* through 76*d* are substantially similar to each other. In this particular embodiment, the bodies 76 through 76*d* have a substantially circular shape. In alternative preferred embodiments, the bodies can have any geometric, curved or irregular shape provided that the bodies are substantially similar to each other. The projections 78*a* through 78*d* extend from the bodies 76*a* through 78*d* and define first, second, third and fourth spacial orientations, respectively, with respect to each other. The first spacial orientation is different than the second spacial orientation. The first spacial orientation can also be different from the second, third and/or fourth spacial orientations. In the preferred embodiment of FIGS. 1-5, the projections 78*a* through 78*d* radially extend from a center 80 of the bodies 76*a* through 76*d* to define first through fourth angles 82*a* through 82*d*, respectively. In a preferred embodiment the first through fourth angles 82*a* through 82*d* vary from each other by at least 10 degrees. In another preferred embodiment, one or more of the first, second, third and/or fourth angles (82*a*, 82*b*, 82*c* and/or 82*d*) can vary by at least 30 degrees from one or more of the other of the first, second, third and/or fourth angles. In other preferred embodiments, one or more of the first, second, third and/or fourth angles (82*a*, 82*b*, 82*c* and/or 82*d*) can vary by other angular amounts from one, or more than one, of the other of the first, second, third and/or fourth angles.

Figure 6:
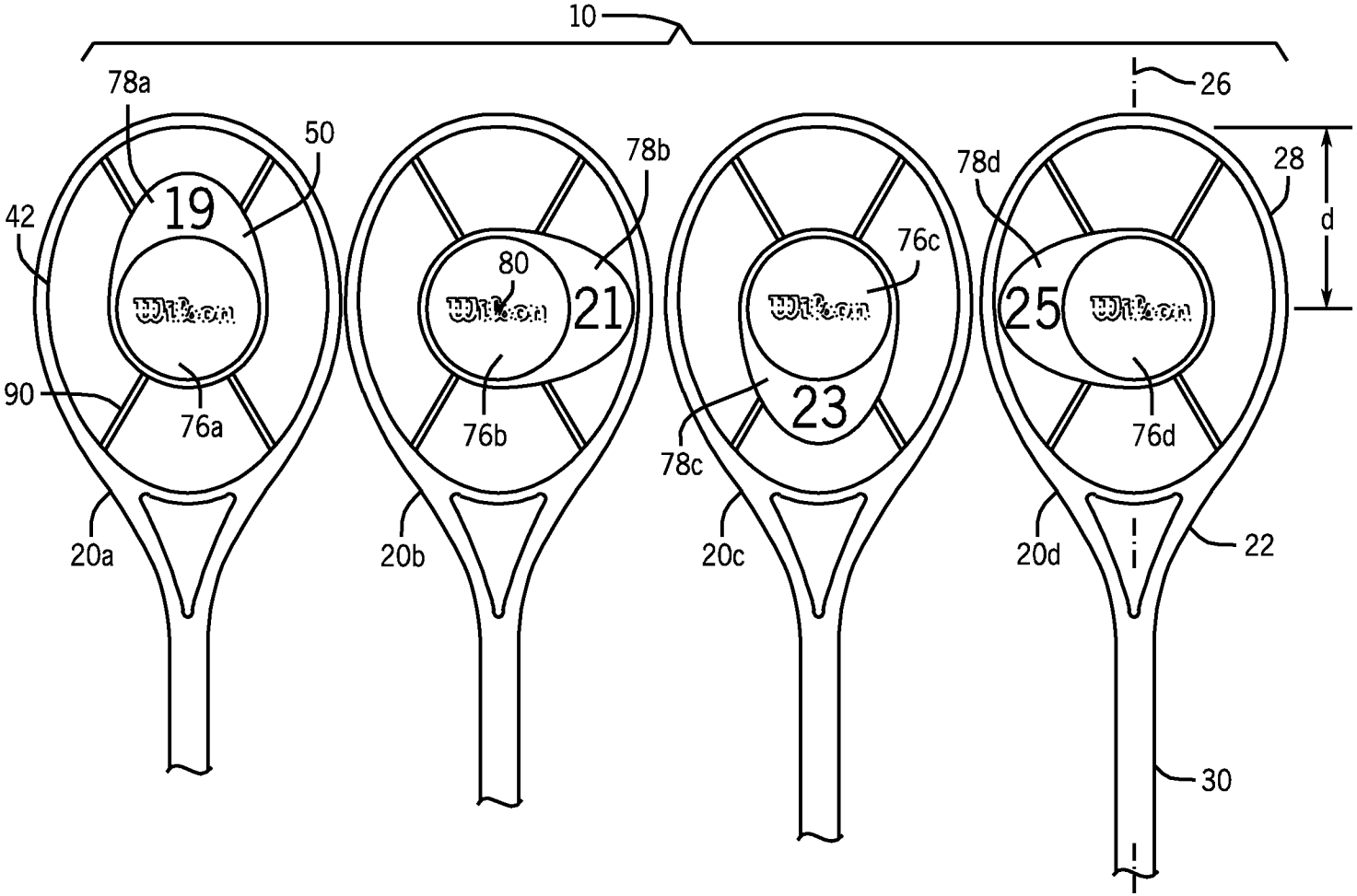
FIG. 6 is a front view of a set of racquets that vary by at least one characteristic and including a racquet identification system in accordance with an alternative preferred embodiment of the present invention.
Figure 7:
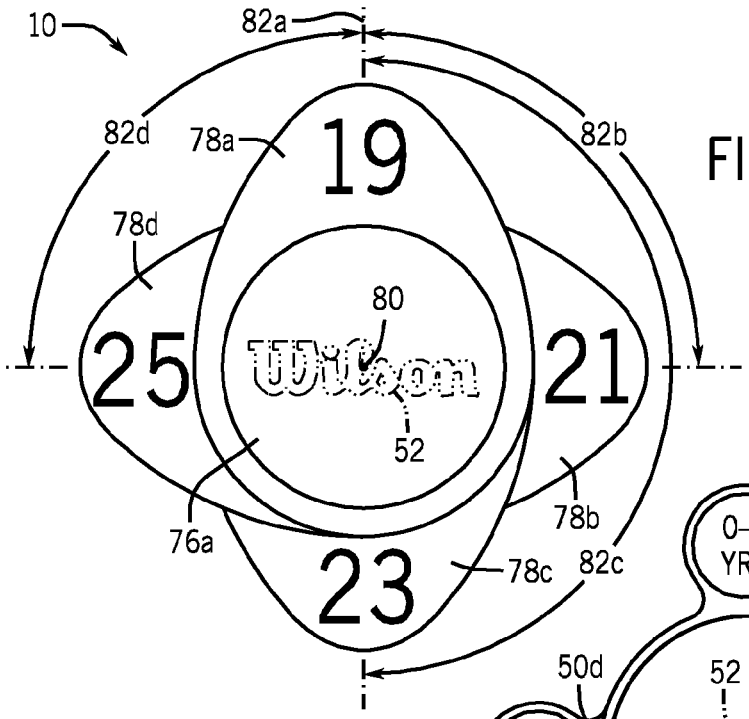
FIG. 7 is a front view of the racquet identification system of FIG. 6.

Referring to FIGS. 6 and 7, an alternative preferred embodiment of the racquet identification system 10 is illustrated. The plurality of racquets 20 are a quantity of four and the characteristic that varies between the four racquets 20 is racquet length. In other preferred embodiments, other numbers of racquets can be used, and other characteristics can be used. The racquets 20 of FIG. 6 are unstrung racquets that are displayed and sold without racquet string. The racquets 20 include the head cards 50. The head cards 50 are coupled to the frame 22 of the racquet 20 by at least one head card attachment element 90. The head card attachment element 90 is a fastening device that serves to position the head card 50 within the hoop 42 of the head portion 28 of the racquet 20. The attachment element 90 can be a single element, or two or more elements. The attachment elements 90 can be formed of an elastic band, a plastic strip, a metallic retainer or an combination of fastening devices. The attachment element 90 positions the head card 50 within the hoop 42 and orientates the head card 50 such that it is generally aligned with the transverse plane defined by the hoop 42 (where the string bed will be located when the racquet is strung).

The head cards 50*a* through 50*d* of FIGS. 6 and 7 include bodies 76*a* through 78*d* and projections 78*a* through 78*d* extending from a center 80 of the bodies 76*a* through 78*d*, respectively. In this preferred embodiment, the projections 78*a* through 78*d* radially extend from the bodies 76*a* through 76*d* to form first through fourth angles 82*a* though 82*d* with respect to the longitudinal axis 26 of the racquets 20*a* through 20*d*, respectively. In particular, the first angle 82*a* can be 0 degrees, the second angle 82*b* can be 90 degrees, the third angle 82*c* can be 180 degrees, and the fourth angle 82*d* can be 270 degrees (or minus 90 degrees). The first through fourth angles are angularly spaced by an approximately 90 degrees. In alternative preferred embodiments, other angular orientations can also be used. The center 80 of the bodies 76*a* through 76*d* are preferably positioned at approximately the same distance, d, from the location where a support 160 (FIGS. 3 and 4) would hold or support the racquets 20*a* through 20*d*. In this manner, the bodies 76*a* through 76*d* substantially overlap each other when positioned on the support 160 (FIG. 3) and viewed from the sight line 70 (FIG. 3).

Figure 8:
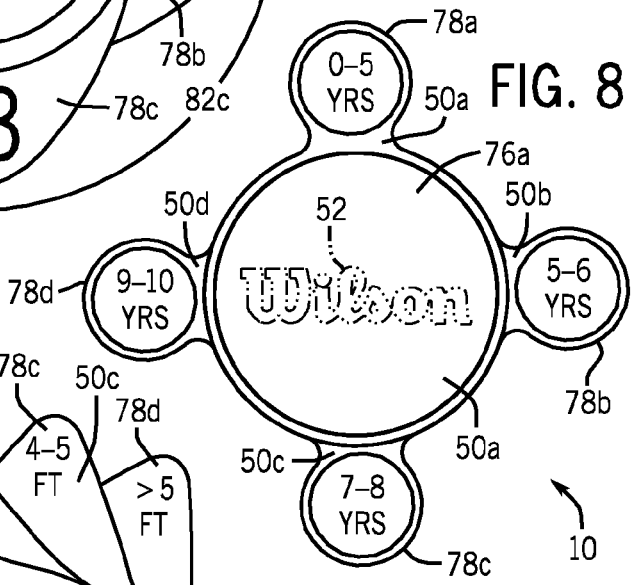
FIG. 8 is a front view of a racquet identification system in accordance with another alternative preferred embodiment of the present invention.

Referring to FIG. 8, another alternative preferred embodiment of the racquet identification system 10 is illustrated. The head cards 50 include bodies 76*a* through 76*d* (bodies 76*b* through d are overlapped by body 76*a*). The projections 78*a* through 78*b* extend from the bodies 76*a* through 76*d*. The head cards 50 of the present embodiment are intended for use with racquets 20 having four different configurations, wherein each configuration is intended for or targeted to a particular user age group. In particular, the first head card 50*a* is intended for use with a racquet 20 configured for use by users between the ages of 0 to 5 years of age. The second head card 50*b* is intended for use with a racquet 20 configured for use by users between the ages of 5 to 6 years of age. The third head card 50*c* is intended for use with a racquet 20 configured for use by users between the ages of 7 to 8 years of age, and the fourth head card 50*d* is intended for use with a racquet 20 configured for use by users between the ages of 9 to 10 years of age. In other alternative preferred embodiments, other numbers of racquet configurations can be used and other target age ranges can be used.

Figure 9:
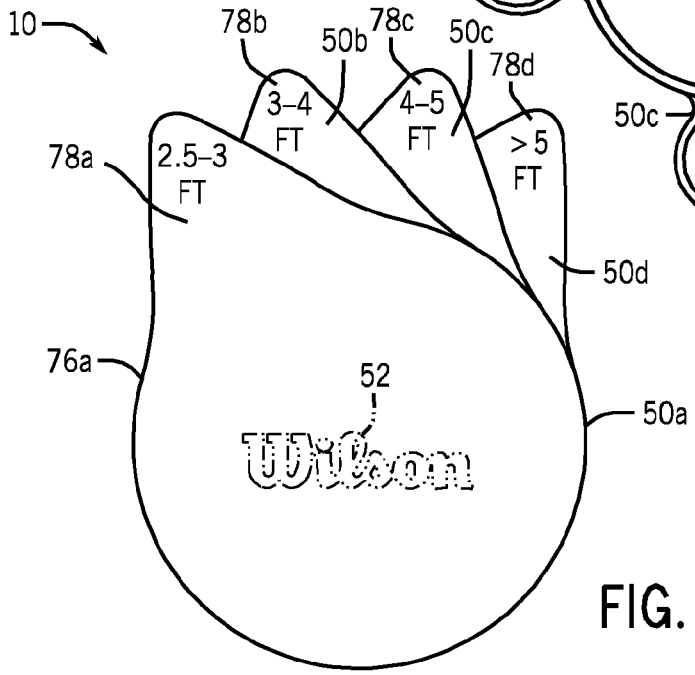
FIGS. 9 through 14 illustrate front views of racquet identification systems in accordance with additional alternative preferred embodiments of the present invention.

Referring to FIG. 9, another alternative preferred embodiment of the racquet identification system 10 is illustrated. The head cards 50 include bodies 76*a* through 76*d* (bodies 76*b* through d are overlapped by body 76*a*). The projections 78*a* through 78*b* extend from the bodies 76*a* through 76*d*. The head cards 50 of the present embodiment are intended for use with racquets 20 having four different configurations, wherein each configuration is intended for, or targeted to, users within a particular height range. In particular, the first head card 50*a* is intended for use with a racquet 20 configured for use by users having a height within the range of 2.5 to 3.0 feet. The second head card 50*b* is intended for use with a racquet 20 configured for use by users having a height within the range of 3 to 4 feet. The third head card 50*c* is intended for use with a racquet 20 configured for use by users having a height within the range of 4 to 5 feet, and the fourth head card 50*d* is intended for use with a racquet 20 configured for use by users having a height greater than 5 feet. In other alternative preferred embodiments, other numbers of racquet configurations can be used and other target user height ranges can be used.

Figure 10:
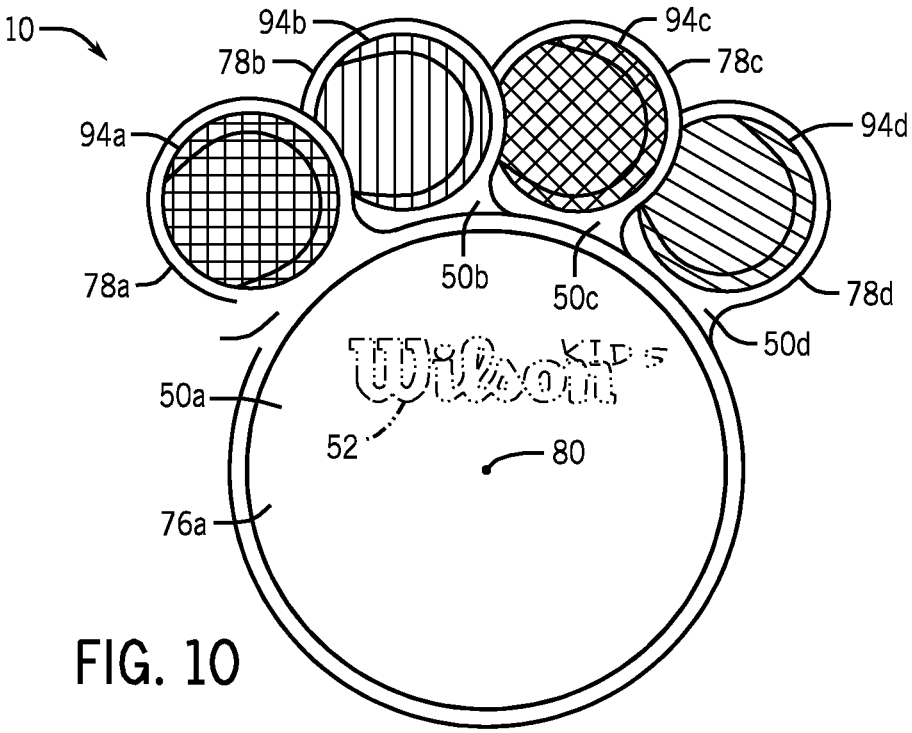

Referring to FIG. 10, another alternative preferred embodiment of the racquet identification system 10 is illustrated. The head cards 50 include bodies 76*a* through 76*d* (bodies 76*b* through d are overlapped by body 76*a*). The projections 78*a* through 78*b* extend from the bodies 76*a* through 76*d*. The head cards 50 of the present embodiment are intended for use with racquets 20 having four different configurations, wherein each configuration is intended for use with a different tennis ball type. Tennis balls can be sold with different colors or color patterns. A particular color pattern can relate to a particular level of play or training exercise/program. In particular, the first head card 50*a* is intended for use with a racquet 20 configured for use by users with a yellow ball. The projection 78*b* includes an image of a ball 94*a* that is lined to represent the color yellow. The second head card 50*b* is intended for use with a racquet 20 configured for use by users with a red ball. The projection 78*b* includes an image of a ball 94*b* that is lined to represent the color red. The third head card 50*c* is intended for use with a racquet 20 configured for use by users with an orange ball. The projection 78*c* includes an image of a ball 94*c* that is lined to represent the color orange. The fourth head card 50*d* is intended for use with a racquet 20 configured for use by users with a generally green colored ball. The projection 78*d* includes an image of a ball 94*d* that is lined to represent the color green. In other alternative preferred embodiments, other numbers of racquet configurations can be used and other ball colors can be used for the four racquets shown or for other numbers of racquets and combinations of racquets and colors.

Figure 11:
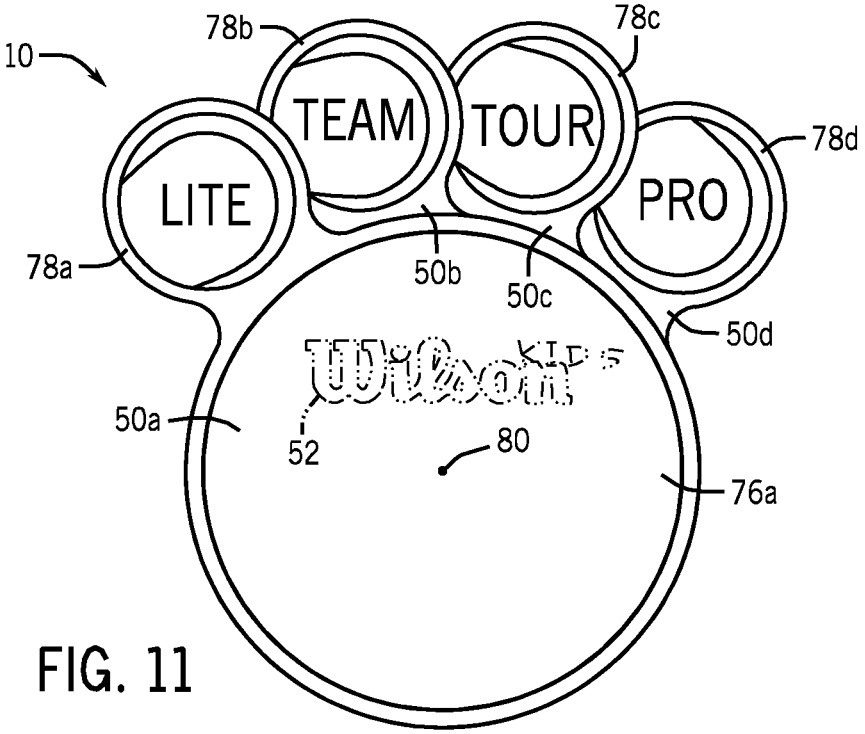

Referring to FIG. 11, another alternative preferred embodiment of the racquet identification system 10 is illustrated. The head cards 50 include bodies 76*a* through 76*d* (bodies 76*b* through d are overlapped by body 76*a*). The projections 78*a* through 78*b* extend from the bodies 76*a* through 76*d*. The head cards 50 of the present embodiment are intended for use with racquets 20 having four different model names or trademarks associated with the racquets 20. In particular, the first head card 50*a* is intended for use with a racquet 20 given the model name or trademark LITE. The second head card 50*b* is intended for use with a racquet 20 given the model name or trademark TEAM. The third head card 50*c* is intended for use with a racquet 20 given the model name or trademark TOUR, and the fourth head card 50*d* is intended for use with a racquet 20 given the model name or trademark PRO. In other alternative preferred embodiments, other numbers of racquet configurations can be used and other trademarks or model names can be used. In other preferred embodiments, other indicia can be used.

Figure 12:
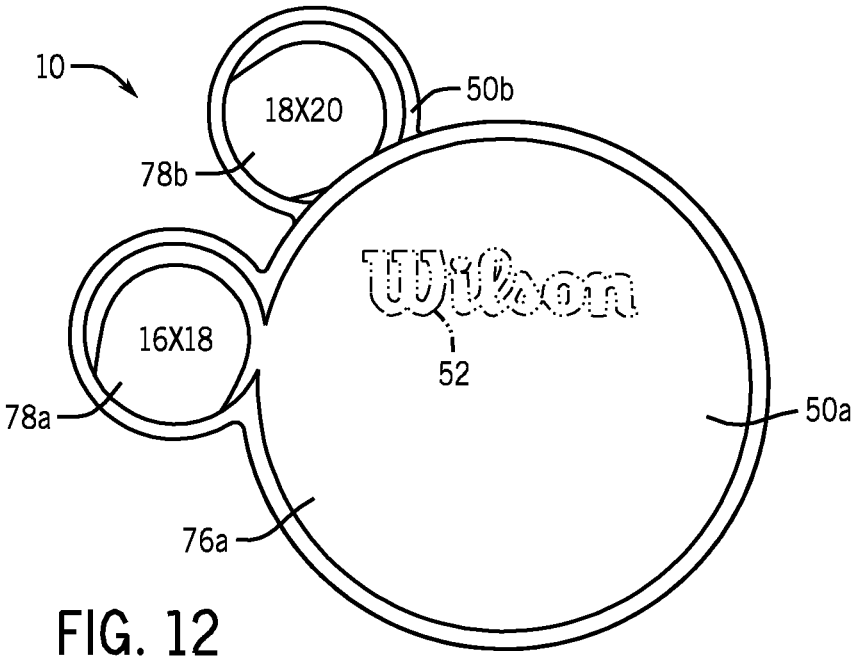

Referring to FIG. 12, another alternative preferred embodiment of the racquet identification system 10 is illustrated. The head cards 50 include bodies 76*a* and 76*b* (body 76*b* is overlapped by body 76*a*). The projections 78*a* and 78*b* extend from the bodies 76*a* and 76*b*. The head cards 50 of the present embodiment are intended for use with racquets 20 having two different configurations. In particular, the head cards 50 are intended for use with racquets 20 having head portions 28 that are configured for two different string patterns. The first head card 50*a* is configured for a racquet having a head portion configured to support a string bed 24 having sixteen main string segments 44 and eighteen cross-string segments 46 (also referred to as a 16 by 18 string pattern). The second head card 50*b* is configured for a racquet 20 having a head portion 28 configured to support a string bed 24 having eighteen main string segments 44 and twenty cross-string segments 46 (also referred to as a 18 by 20 string pattern). In other alternative preferred embodiments, other numbers of racquet configurations can be used other than two, and other string patterns can be used.

Figure 13:
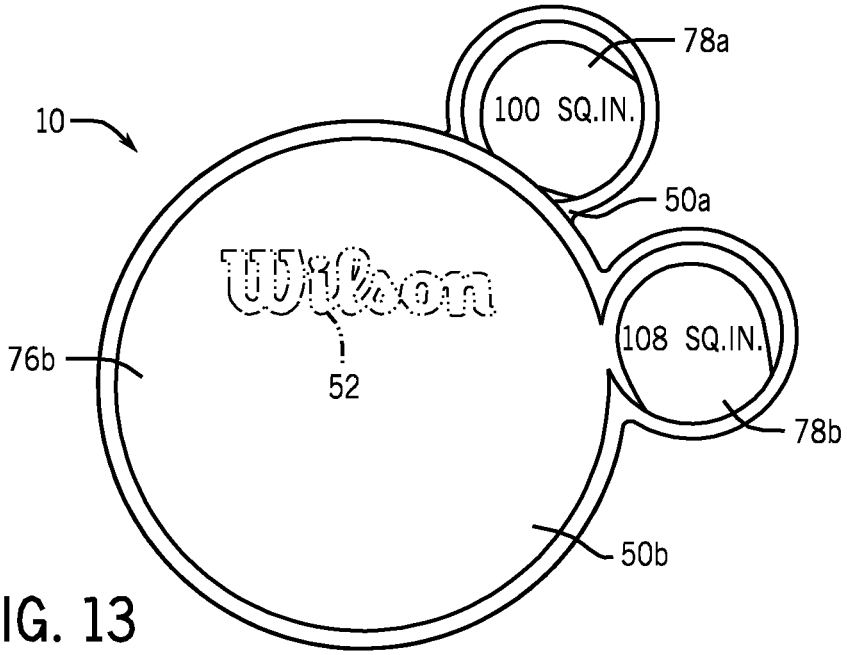

Referring to FIG. 13, another alternative preferred embodiment of the racquet identification system 10 is illustrated. The head cards 50 include bodies 76*a* and 76*b* (body 76*a* is overlapped by body 76*b*). The projections 78*a* and 78*b* extend from the bodies 76*a* and 76*d*. The head cards 50 of the present embodiment are intended for use with racquets 20 having two different configurations. In particular, the head cards 50 are intended for use with racquets 20 having two different head sizes. The first head card 50*a* is intended for use with a racquet 20 having a head size of 108 sq. inches. The second head card 50*b* is intended for use with a racquet 20 having a head size of 100 sq. inches. In other alternative preferred embodiments, other numbers of racquet configurations can be used besides two, and other head sizes can be used.

Figure 14:
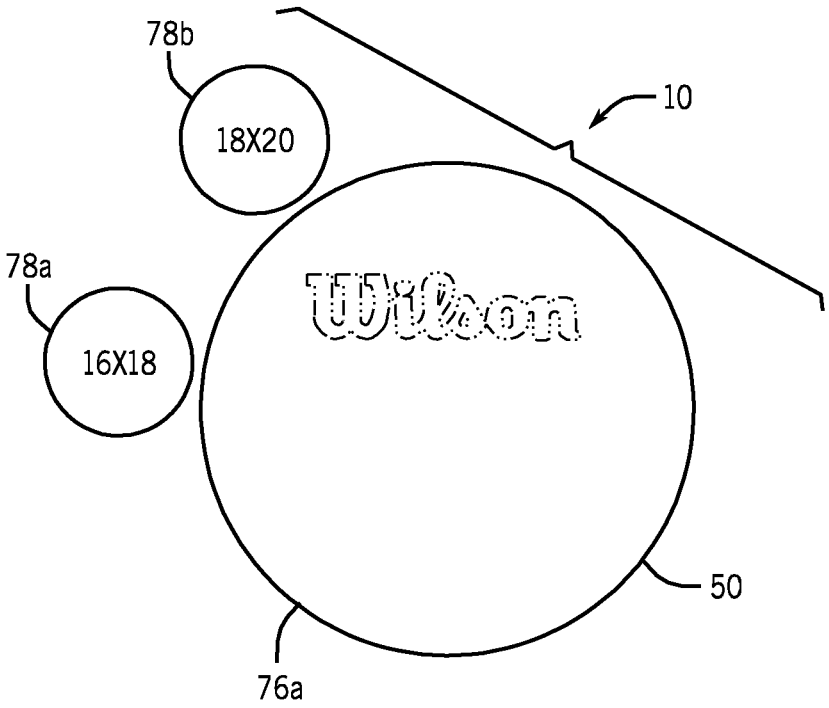

Referring to FIG. 14, another alternative preferred embodiment of the racquet identification system 10 is illustrated, the head card 50 can be a head card assembly wherein the body 76 is separated from the projection 78. The body 76 and the projection 78 can be attached to the string bed 24 or to the frame 22 of the racquet 20 by separate attachment elements 90. The body 76 and the projection 78 although separate pieces still define a spacial relationship with respect to each other. When two or more head card assemblies are used, two or more bodies and two or more projections can form two or more spacial relationships with respect to each other, respectively. In particular, body 76*a* can define a first spacial relationship with projection 78*a*, and body 76*b* can define a second spacial relationship with projection 78*b*. In FIG. 14, body 76*a* overlaps body 76*b*. Many of the other attributes of the racquet identification system 10 described above with respect to the other embodiments are applicable to the embodiment of FIG. 14.

The racquet identification system 10 of the present invention can be used with any numbers of two or more racquets. The head cards 50 can include bodies of any type of shape. The bodies 76 can be circular or any other shape including other geometric shapes, other curved shapes, other irregular shapes or combinations thereof. The projections 78 extend from the bodies 76. The projections 78 can take any shape as long as they extend from the body 76 and/or define a unique spacial relationship with the body 78. The body and/or the projections can include one or more characteristics. Many such characteristics have been shown in the drawings. One of skill in the art would readily understand that other characteristics can be used in place of those explicitly shown in the drawings and are contemplated in the present invention. Other such characteristics include, but are not limited to, moment of inertia about the longitudinal axis 26, which can vary from one racquet to another, moment of inertia about the axis 52, swing speed, balance point and racquet vibration response upon impact.

The racquet identification system 10 provides a system for overcoming or reducing the likelihood of a consumer viewing an outermost racquet on display in a retail setting, and failing to realize or recognize that another racquet (positioned behind the outermost racquet or outermost racquets) having a different characteristic than the outermost racquet is positioned behind the outermost racquet. The racquet identification system allows a consumer to readily identify that multiple types of racquets are present on a single peg in a display or retail setting. The racquet identification system also allows for a consumer to quickly distinguish between multiple racquets on a single peg and go to the racquet that interests the consumer. The racquet identification system can increase the likelihood that racquets positioned away from the outermost position on a peg will be noticed, examined and purchased by a consumer.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A racquet identification system for use with a multi-racquet support structure, the identification system comprising:

at least first and second racquets, each of the at least first and second racquets having opposing front and back sides and including a head portion, the at least first and second racquets configured to be supported by the multi-racquet support structure such that the back side of one of the at least first and second racquets is adjacent to the front side of another of the at least first and second racquets, the at least first and second racquets having at least one characteristic that varies between at least the first and second racquets; and at least first and second head cards coupled to the head portion of the at least first and second racquets, respectively, the at least first and second head cards including at least first and second bodies and at least first and second projections extending from the at least first and second bodies, respectively, the shape of the first body being substantially similar to the shape of the second body, the first body and the first projection defining a first spacial orientation, the second body and the second projection defining a second spacial orientation, the first spacial orientation being different than the second spacial orientation.

2. The racquet identification system of claim 1, wherein the at least first and second projections are configured to highlight the at least one characteristic that varies between the at least first and second racquets.

3. The racquet identification system of claim 1, wherein each of the first and second racquets define a longitudinal axis, wherein the first body defines a first center point and the first projection radially extends from the first center point to define a first angle with respect to the longitudinal axis of the first racquet, wherein the second body defines a second center point and the second projection radially extends from the second center point to define a second angle with respect to the longitudinal axis of the second racquet, and wherein the first angle and second angles are different.

4. The racquet identification system of claim 3, wherein the first and second angles are radially spaced apart by at least 10 degrees.

5. The racquet identification system of claim 1, wherein, when viewed facing the outermost front surface of the at least first and second racquets, the body of the head card of the outermost of the first and second racquets substantially overlaps the body of the head card of the other of the at least first and second racquets.

6. The racquet identification system of claim 1, wherein the head portion of each of the at least first and second racquets defines a hoop, and wherein the at least first and second head cards are positioned within the hoops of the at least first and second racquets, respectively.

7. The racquet identification system of claim 6, wherein each of the at least first and second head cards extends over at least 25 percent of the transverse area defined by the hoop.

8. The racquet identification system of claim 1, wherein the at least first and second racquets further include at least first and second string beds coupled to the at least first and second head portions, respectively; and wherein the at least first and second head cards are attached to the at least first and second string beds, respectively.

9. The racquet identification system of claim 1, further comprising at least first and second head card attachment elements configured to attach the at least first and second head cards to the at least first and second racquets, respectively.

10. The racquet identification system of claim 1, wherein the at least one characteristic is at least the length of the racquet.

11. The racquet identification system of claim 1, wherein the at least one characteristic is at least the target age range of the users of the at least first and second racquets.

12. The racquet identification system of claim 1, wherein the at least one characteristic is at least the target height range of the users of the at least first and second racquets.

13. The racquet identification system of claim 1, wherein the at least one characteristic is at least the ball type intended to be used with the at least first and second racquets.

14. The racquet identification system of claim 1, wherein the at least one characteristic is selected from the group consisting of racquet head size, racquet weight, racquet swing weight, racquet balance point, moment of inertia about a longitudinal axis, color, color pattern, trademarks, alpha-numeric and/or graphical indicia and combinations thereof.

15. A racquet identification system for use with at least first and second racquets supported by a multi-racquet support structure, each of the at least first and second racquets including a head portion, the identification system comprising:

at least first and second head cards coupled to the head portion of the at least first and second racquets, respectively, the at least first and second head cards including at least first and second bodies and at least first and second projections extending from the first and second bodies, respectively, the shape of the first body being substantially similar to the shape of the second body, the first body and the first projection defining a first spacial orientation, the second body and the second projection defining a second spacial orientation, the first spacial orientation being different than the second spacial orientation, the at least first and second racquets having at least one characteristic that varies between at least the first and second racquets, and the at least first and second projections being configured to highlight the at least one characteristic.

16. The racquet identification system of claim 15, wherein each of the at least first and second racquets has opposing front and back sides, wherein the at least first and second racquets supported by the multi-racquet support structure such that the back side of one of the at least first and second racquets is adjacent to the front side of another of the at least first and second racquets, and wherein, when viewed facing the outermost front surface of the at least first and second racquets, the body of the head card of the outermost of the first and second racquets substantially overlaps the body of the head card of the other of the at least first and second racquets.

17. The racquet identification system of claim 15, wherein the at least one characteristic is at least the length of the racquet.

18. The racquet identification system of claim 15, wherein the at least one characteristic is at least the target age range of the users of the at least first and second racquets.

19. The racquet identification system of claim 15, wherein the at least one characteristic is at least the target height range of the users of the at least first and second racquets.

20. The racquet identification system of claim 15, wherein the at least one characteristic is at least the ball type intended to be used with the at least first and second racquets.

21. The racquet identification system of claim 15, wherein the at least one characteristic is selected from the group consisting of racquet head size, racquet weight, racquet swing weight, racquet balance point, moment of inertia about a longitudinal axis, color, color pattern, trademarks, alpha-numeric and/or graphical indicia and combinations thereof.

* * * * *